US006874618B1

(12) United States Patent
Cragg

(10) Patent No.: US 6,874,618 B1
(45) Date of Patent: Apr. 5, 2005

(54) AMMUNITION CONTAINER

(76) Inventor: James Victor Cragg, 8515 Washington Blvd., Culver City, CA (US) 90232

( * ) Notice: Subject to any disclaimer, the term of this patent is extended or adjusted under 35 U.S.C. 154(b) by 0 days.

(21) Appl. No.: 10/690,966

(22) Filed: Oct. 23, 2003

(51) Int. Cl.[7] ..... F41C 27/00
(52) U.S. Cl. ..... 206/3; 42/90
(58) Field of Search ..... 42/90, 90.1; 89/34, 89/35.01; 206/3, 139, 315.11, 317, 371, 379, 443; 217/18; 224/198, 199, 223, 196, 600, 601, 602, 603, 604, 605, 620, 629, 660, 664, 665, 666

(56) References Cited

U.S. PATENT DOCUMENTS 368,579 A * 8/1887 Frazier ..... 224/239
1,176,266 A * 3/1916 Batchelder ..... 214/681
1,392,551 A * 10/1921 Batchelder ..... 224/683
1,551,061 A * 8/1925 Silcott ..... 221/185
2,397,200 A * 3/1946 Perry ..... 224/236
2,566,569 A * 9/1951 Jensen ..... 224/239
2,605,033 A * 7/1952 Terry ..... 224/0.5
3,552,610 A * 1/1971 Coleman et al. ..... 224/240
4,194,657 A * 3/1980 Thor ..... 224/667
4,666,035 A * 5/1987 Johnson ..... 206/3
4,676,419 A * 6/1987 Victor ..... 224/649
4,942,991 A * 7/1990 Lyons ..... 224/196
4,966,320 A * 10/1990 DeSantis et al. ..... 224/665
4,972,758 A * 11/1990 Austin et al. ..... 89/34
5,009,346 A * 4/1991 Butler ..... 224/605
5,152,442 A * 10/1992 Gallagher ..... 224/245
5,190,196 A * 3/1993 Hamer, III ..... 224/625
5,246,153 A * 9/1993 Beletsky ..... 224/192
5,265,365 A * 11/1993 Finn ..... 42/74
5,294,031 A * 3/1994 Volpei et al. ..... 224/682
5,319,872 A * 6/1994 Bammate ..... 42/88
5,445,303 A * 8/1995 Cawile, Jr. ..... 224/222
5,619,819 A * 4/1997 Hauschild ..... 43/26
5,680,973 A * 10/1997 Vulpitta et al. ..... 224/153
5,771,622 A * 6/1998 Koziuk et al. ..... 42/74
5,775,558 A * 7/1998 Montalbano ..... 224/627
5,785,219 A * 7/1998 Kraft ..... 224/576
5,996,865 A * 12/1999 Bissey ..... 224/275
6,076,715 A * 6/2000 Easter ..... 224/149
6,164,180 A * 12/2000 Sulm et al. ..... 89/33.16
D455,548 S * 4/2002 Cragg ..... D3/224
6,374,719 B1 * 4/2002 Phillips ..... 89/34
6,431,420 B1 * 8/2002 Cragg ..... 224/223
6,471,054 B2 * 10/2002 Nevarez ..... 206/315.11
6,488,148 B1 * 12/2002 Woodson ..... 206/317
6,685,066 B2 * 2/2004 Cragg ..... 224/192
6,688,504 B1 * 2/2004 Kirkaldy ..... 224/196
6,691,906 B2 * 2/2004 Cragg ..... 224/238
6,789,711 B2 * 9/2004 Kinsella ..... 224/275
2002/0104768 A1 * 8/2002 Nevarez ..... 206/315.11
2003/0094470 A1 * 5/2003 Cragg ..... 224/236
2003/0141328 A1 * 7/2003 Cragg ..... 224/192

* cited by examiner

*Primary Examiner*—Michael J. Carone
*Assistant Examiner*—John Richardson
(74) *Attorney, Agent, or Firm*—Raymond Y. Chan; David and Raymond

(57) ABSTRACT

An ammunition container includes a pouch having a top opening and a storage cavity for receiving the magazine loaded with the bullets therein and a magazine retaining device which includes an elongated element having an affixing end extended from the storage cavity and a free end extending over the storage cavity toward a front surface of the front wall, and a fastening unit provided on the front surface of the front wall to detachably fasten with the free end of the elongated element. Therefore, the elongated element substantially passes through a bullet gap to press on the magazine for substantially retaining the magazine within the storage cavity while each of the bullets is capable of being extracted from the magazine.

20 Claims, 5 Drawing Sheets

AMMUNITION CONTAINER

BACKGROUND OF THE PRESENT INVENTION

1. Field of Invention

The present invention relates to an ammunition carrier, and more particularly to an ammunition container comprising a magazine retaining device adapted to securely hold at least a magazine in the ammunition container while the bullets are allowed to extract from the magazines.

2. Description of Related Arts

Many accessories have been developed for better use of firearms. Efforts have been dedicated to the development of ammunition containers in order to carry more bullets when using the firearm. Conventionally, an ammunition container may be made as a pocket or pouch that includes a storage space in which bullets are freely stored without arrangement. A flap of some sort is provided to enclose the storage space and prevent the bullets from dropping off from the container. A user may carry the container for supply of ammunition when he is using his firearms.

One disadvantage of the aforementioned ammunition container is that the bullets are very easily to drop off from the container when the flap is opened for retrieval of bullets, because the bullets are randomly disposed without any restriction within the pouch. Another disadvantage is that those randomly disposed bullets do not make the best use of the storage space of the container. One conventional solution to the disadvantages is to arrange the bullets within a magazine, which is then put in a pouch or attached to other harness. One example can be found in U.S. Pat. No. 5,265,365, in which a row of slots are formed on a piece of leather to be attached to a rifle stock. In this case, bullets are independently inserted in the slots so that bullets are better held therein so that extracting one bullet from the slot would not easily cause other ones dropping off to the ground.

While the abovementioned design better arranges bullets in a row of slots, the conventional art provides rather limited bullet supply. Given the length of a standard rifle stock, not too many bullet slots can be made on the piece of leather for attaching thereto. As a result, the design carries only a few numbers of bullets. In other words, it may burden a user with the necessity of bring an extra ammunition container for his bullet supply.

A conventional approach to addressing this issue includes a magazine having many slots in which bullets are inserted and an easy-carried container for storage of the magazine. Slots are formed in the magazines for receiving the bullets. They are long and tight enough to firmly store the bullets, and short enough to expose the end portions of the bullets outside the magazine. The user may easily extract the bullets from the magazine by gripping the end portion of the bullets. The capacity of the magazine may go from several bullets to several tens of bullets. More than one of those magazines may be put in a pouch that is enclosed with a flap that prevents the bullets from dropping off.

One drawback of the conventional approach happens when retrieving the bullets. In order to hold the bullets in the magazines, the bullet slots are tight enough to provide friction. As one bullet is extracted from the magazine, the friction between the slot and the bullets usually pulls the whole magazine along with the movement of the bullets being extracted. This may cause the magazine inadvertently falling from the pouch to the ground.

In view of the above, what is needed is an ammunition container that can store many bullets in an organized way, wherein the bullets are easily extracted from a magazine of some sort without pulling up the magazine along with the bullet being extracted.

SUMMARY OF THE PRESENT INVENTION

A main object of the present invention is to provide an ammunition container with a magazine retaining device that retains magazines within a pouch of the ammunition container while allowing the bullets in the magazines being extracted therefrom.

Another object of the present invention is to provide an ammunition container with a magazine retaining device accommodating the various thickness and number of the magazines stored in the pouch of the ammunition container.

Another object of the present invention is to provide an ammunition container, wherein the magazine retaining device does not significantly alter the original structural design of the ammunition container, so as to minimize the manufacturing cost of the ammunition container incorporating with the magazine retaining device.

Another object of the present invention is to provide an ammunition container with a magazine retaining device that retains the magazines within the pouch of the ammunition container in a balanced way in order to avoid unwanted movement of the magazines when bullets are extracted therefrom.

Another object of the present invention is to provide an ammunition container with a magazine retaining device that provides various degrees of retaining bias against the top edge of the magazine stored in the pouch of the ammunition container.

Another object of the present invention is to provide an ammunition container with attaching means that is capable of mounting the container to a rifle stock.

Another object of the present invention is to provide an ammunition container with mounting means that is capable of mounting the container to a user's body or battle load carrying harness.

Accordingly, in order to accomplish the above objects, the present invention discloses an ammunition container for holding a magazine with slots receiving bullets therein. The ammunition container comprises a pouch, elongated element and fastening unit. The pouch is essentially constituted of a back wall and front wall that define a storage cavity with an opening for receiving the magazine loaded with the bullets. The elongated element has a fixed end secured within the storage cavity and a free end adapted to extending over the storage cavity toward the front side of the front wall, wherein the elongated element has a width adapted for slidably passing through a gap between two bullets held on the magazine. The fastening unit is provided on the front side of the pouch to detachably fix the free end of the elongated element thereon. As a result, the elongated element and fastening unit may substantially retain the magazine in such a way that the bullets are capable of being extracted from the magazine while keeping the magazine retained in the pouch.

These and other objectives, features, and advantages of the present invention will become apparent from the following detailed description, the accompanying drawings, and the appended claims.

BRIEF DESCRIPTION OF THE DRAWINGS

The present disclosure will be more clearly understood after reference to the following detailed specification is read in conjunction with the drawings, wherein.

DETAILED DESCRIPTION OF THE PREFERRED EMBODIMENT

Figure 1:
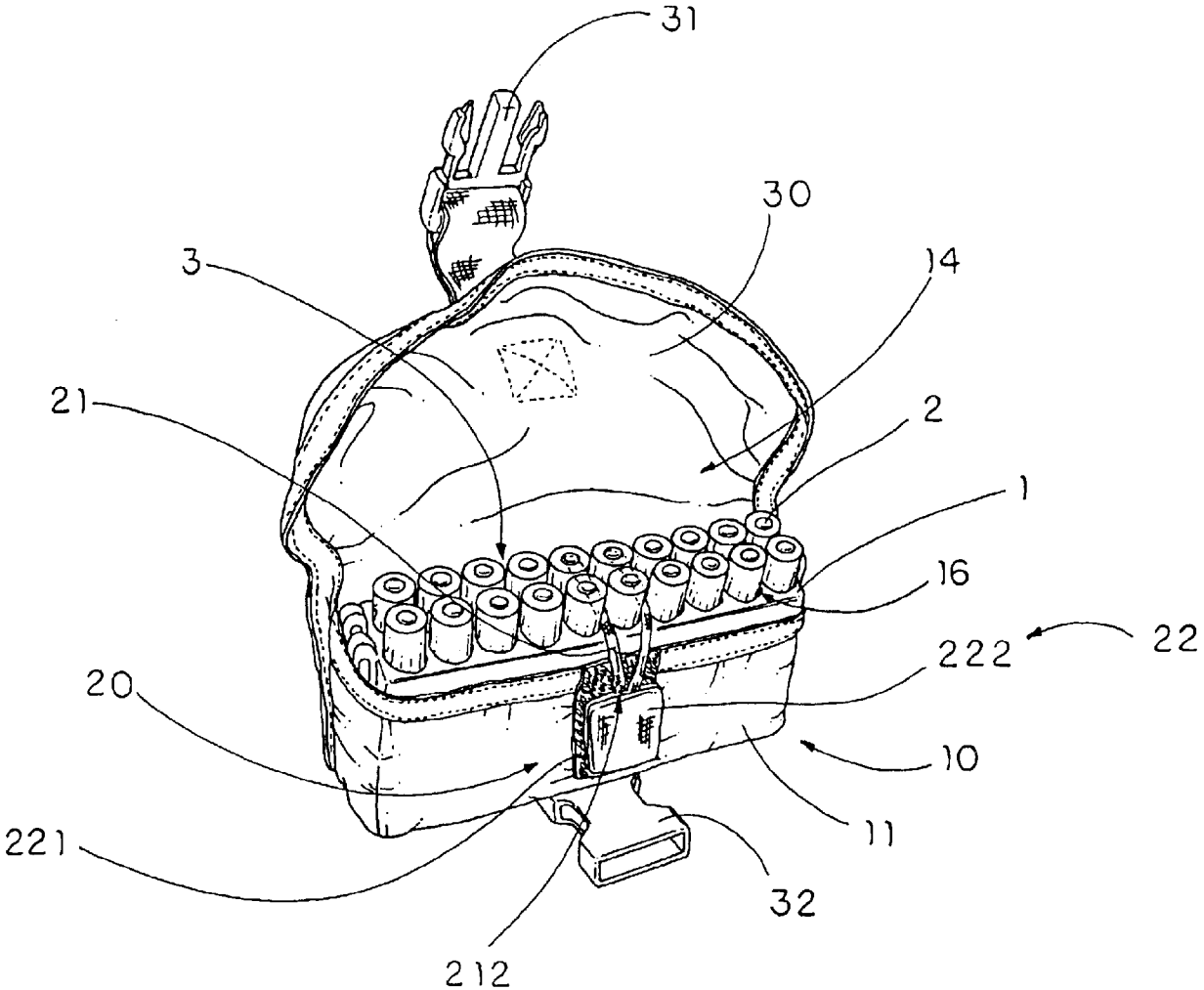
FIG. 1 is a perspective view of an ammunition container according to one preferred embodiment of the present invention.
Figure 2:
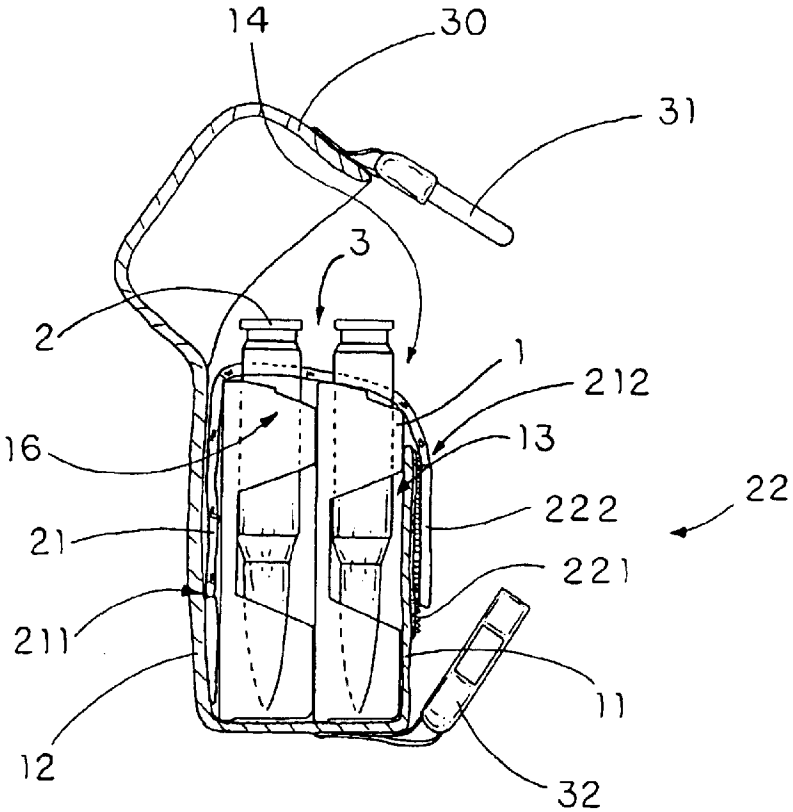
FIG. 2 is a cross-sectional view of the abovementioned ammunition container according to the preferred embodiment of the present invention.

Referring to FIG. 1 and FIG. 2, an ammunition container according to one of the preferred embodiment of the present invention is shown. The ammunition container includes, but not limited to, a pouch 10, magazine retaining device 20 and shielding flap 30.

The pouch 10 comprises a front wall 11 and a back wall 12 overlapped thereon to define a top opening 14 and a storage cavity 13 between the front wall 11 and the back wall 12 to communicate with the top opening 14.

One or more magazines 1 that include a plurality of slots 16 in which bullets 2 are inserted can be stored within the storage cavity 13 of the pouch 10. The bullets 2 are so disposed in the slots 16 that a top portion of each bullet is exposed outside the magazine 1, wherein a bullet gap 3 is formed between each two the top potions of the bullets 2. A user may easily extract the bullets 2 from the magazine 1 simply by gripping their top portions.

Magazine retaining device 20 comprises an elongated element 21 and fastening unit 22, which is constituted of a first fastening element 221 and a second fastening element 222.

The elongated element 21, according to the preferred embodiment, has an affixing end 211 extended from the storage cavity 13 of the pouch 10 and a free end 212 extended towards a front side of the front wall 11 across the storage cavity 13.

The fastening unit 22 comprises a first fastener 221 provided at the front side of the front wall 11 and a second fastener 222 formed at the free end 212 of the elongated element 21 to detachably fasten with the first element 221 so as to retain a width of the top opening 14 of the pouch 10 for securely locking up the magazine 1 therein.

In a preferred embodiment, the first and second fasteners 221, 222 of the fastening unit 22 are hook and loop fasteners in which the first fastener 221 has a rough surface and the second fastener 222 has a soft surface, or vice versa. It is obvious that the that the fastening unit 22 can also be other types of fasteners, such as buttons, toggles, buckles and snaps, without departing the spirit of the present invention.

The elongated element 21 has a width narrow enough to pass through the bullet gap 3 of the bullets 2 and a length long enough to enable the first fastener 221 to reach the second fastener 222 on the front side of the pouch 10. Once the first fastener 221 is attached to the second fastening element 222, the elongated element 21 retains the magazines 1 within the storage cavity 13 of the pouch 10 without interrupting the extraction of the bullets 2.

As shown in FIG. 1, the second fastener 222, having an elongated shaped, is transversely extended on the front side of the front wall 11 such that the first fastener 221 is selectively fastened along the second fastener 222 to adjust the width of the top opening 14 of the storage cavity 13 via the elongated element 21 so as to securely hold the magazine 1 in the storage cavity 13. Therefore, when two or more magazines 2 are received in the storage cavity 13, the free end 212 of the elongated element 21 is adapted to across the storage cavity 13 and is affixed on the front side of the front wall 11 via the fastening unit 22 to adjust the width of the top opening 14 that the elongated element 21 passes through the bullet gaps 3 to bias on the top edges of the magazines 1 so as to lock up the magazines 1 within the storage cavity 13.

In other words, due to adjustment of the relative positions between the first fastener 221 and the second fastener 222 along a longitudinal direction, the elongated element 21 is able to accommodate the magazines 1 of different numbers and thickness by varying the length of the elongated element 21 that traverses the storage cavity 13. Moreover, the adjustment of the relative positions of the first and second fasteners 221 and 222 may better press the elongated element 21 against the top edges of the magazines 1 so as to better keep them in the pouch.

In a preferred embodiment, the fixed end 211 of the elongated element 21 is substantially secured in the middle of the inner surface of the back wall 12, from which a pair of strings passes through the bullet gaps 3 over the top edges of the magazines 1. It is noted that the elongated element 21 may be constituted of one or more than two strings that are fixed to any different locations within the storage cavity 13 rather than the middle part, without departing from the spirit of the present invention.

Alternatively, the elongated element 22 comprises an elastic band for providing an elastic retaining force against the top edge of the magazine 1 when the first fastener 221 is detachably fastened with the second fastener 222. Therefore, the elongated element 22 is adapted to be pulled to prolong the length thereof to selectively adjust the width of the top opening 14 of the storage cavity 13. In the preferred embodiment, the elongated element 21 applies elastic retaining force approximately to the geographic axis of the magazines 1. Thus, it helps to maintain the magazines 1 in a balanced way in the pouch 10 when the bullets 2 are being extracted therefrom.

The shielding flap 30 is extended from the back wall 12 of the pouch 10 to enclose the storage cavity 13. The flap 30 may be an integral part of the back wall 12, or a foreign piece of material attached thereto. Two connectors, which include a first connector 31 and second connector 32, are provided to the shielding flap 30 and the front wall 11 respectively. Connecting the first and second connectors 31, 32 together, the shielding flap 30 encloses the storage cavity 13 to better protect the bullets 2 from dusts outside the pouch 10 and prevent they dropping off therefrom while transportation. In a preferred embodiment, the first and second connectors 31, 32 are a buckle plug and a buckle socket respectively. It is noted that the fastener may be buttons, toggles, buckles, snaps and zippers, without departing the spirit of the present invention. It is worth to mention that during combat situation, the user is able to open up the storage cavity 13 to expose the bullets 2 wherein the magazine 1 is securely locked up within the storage cavity 13 via the magazine retaining device 20 while the user is able to rapidly extract the bullet 2 from the magazine 1.

Figure 3:
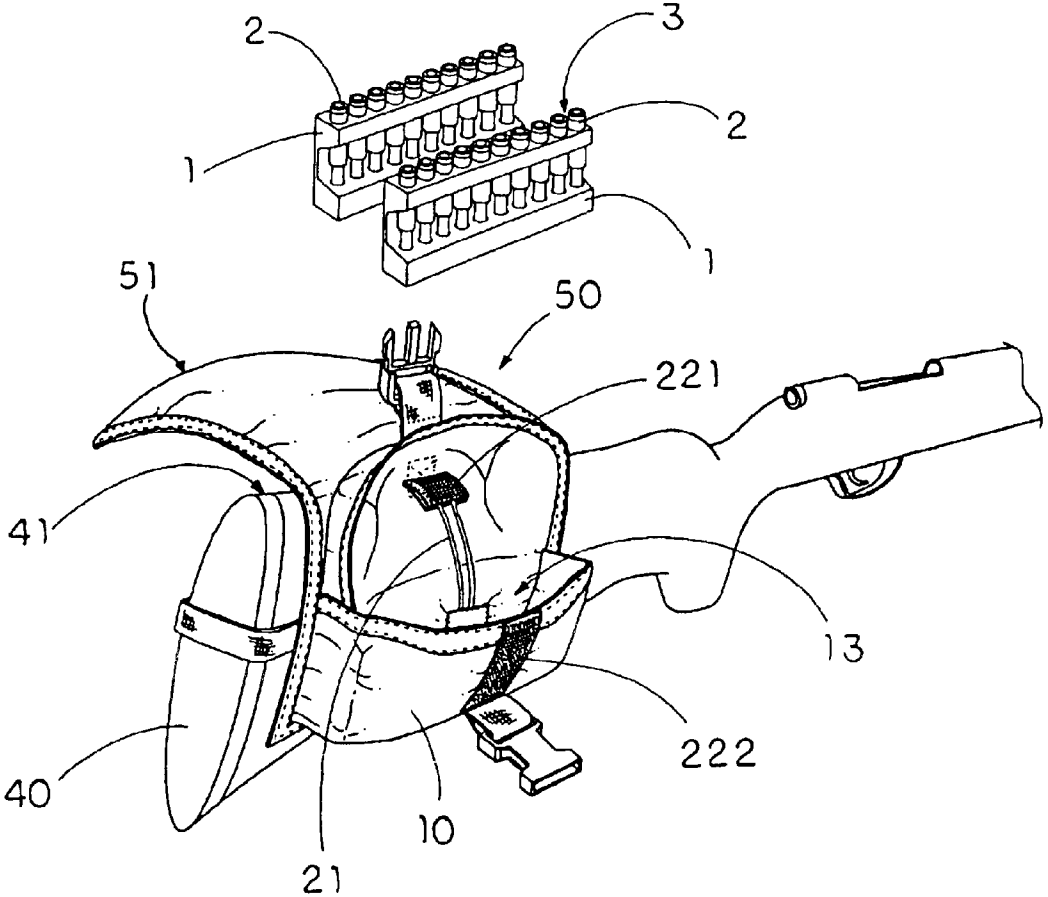
FIG. 3 is a perspective view of the abovementioned ammunition container with attaching means that secures the container on a rifle stock.

Referring to FIG. 3, the ammunition container can be mounted to a rifle stock 40 via an attaching means 50 for better utilization of the present invention. The attaching means 50 has ballistic boundaries 51 along the axis of which the attaching means 50 is adapted for folding around the spine 41 of the rifle stock 40. Fastening means is provided to secure the attaching means around the rifle stock 40 so that a user may easily extract bullets 2 from the magazine 1 within the pouch 10 as he is using the rifle. Because the fastening means may be had according to conventional ways, detailed illustrations are therefore not provided.

Figure 4:
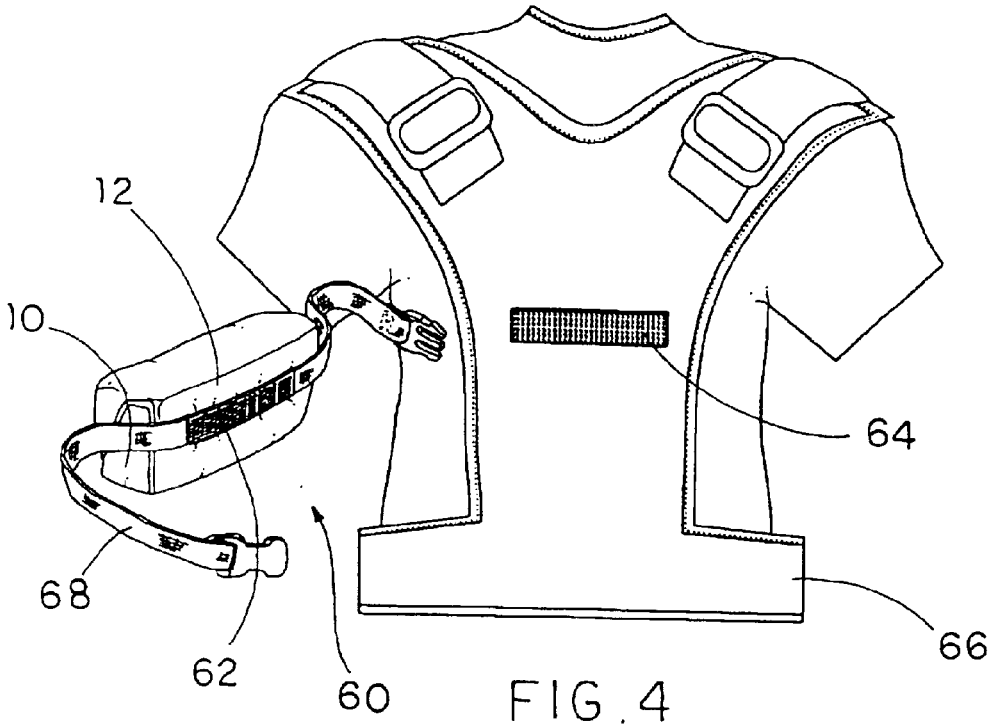
FIG. 4 is a perspective view of the abovementioned ammunition container with attaching means that secures the container to battle load carrying harness according to one preferred embodiment.

Besides mounting the ammunition container to a rifle stock, the attaching means 60, as an alternative mode, can further mounting the ammunition container to a user's body or battle load carrying harness, such as holsters, thigh rigs, vests, belts, packs and travel cases. Referring to FIG. 4, the attaching means 60 is a hook-and-loop fastener, wherein the hook fastener 62 is formed on the back of pouch 10 and the loop fastener 64 is formed on the surface of a vest 66, or vice versa. The pouch 10 is readily attached to and detached from the vest 66, thereby improving its ammunition-carrying capability. As an alternative, the attaching means could be a set of straps 68 so attached onto different areas of the pouch 10 that together they form a mechanism that allows the pouch 10 being moveably mounted to a user's body or other battle load carrying harness.

Figure 5:
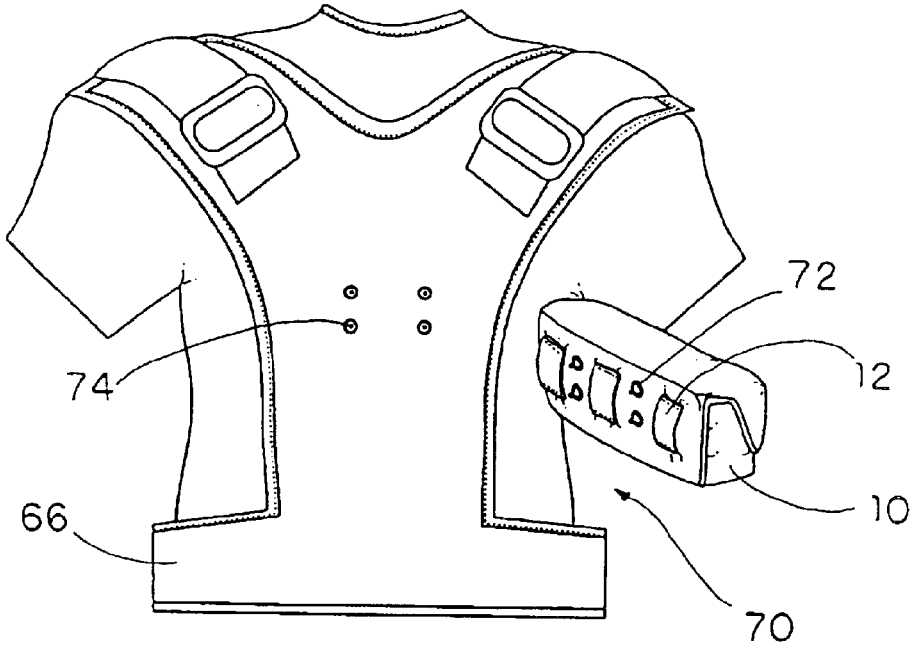
FIG. 5 is a perspective view of the abovementioned ammunition container with attaching means that secures the container to battle load carrying harness according to another preferred embodiment.

Similarly, referring to FIG. 5, the attaching means is a set of snaps 70. Several engaging parts 72 of snaps 70 are attached on the back wall 12 of the pouch 10 and the corresponding receiving parts 74 of the snaps 70 are attached on the surface of vest 66. The number of the pairs of the receiving parts 72 and engaging parts 74 should be more than one so that when the pouch 10 is attached to the vest 66 unwanted movement between the pouch 10 and the vest 66 can therefore be avoided. In the preferred embodiment, four pairs of snaps 70 are provided in a square arrangement in substantially consideration of the mass center of pouch 10. As a result, when the pouch 10 contains magazines and bullets, it can still be attached to the vest 66 in a balanced way.

Figure 6:
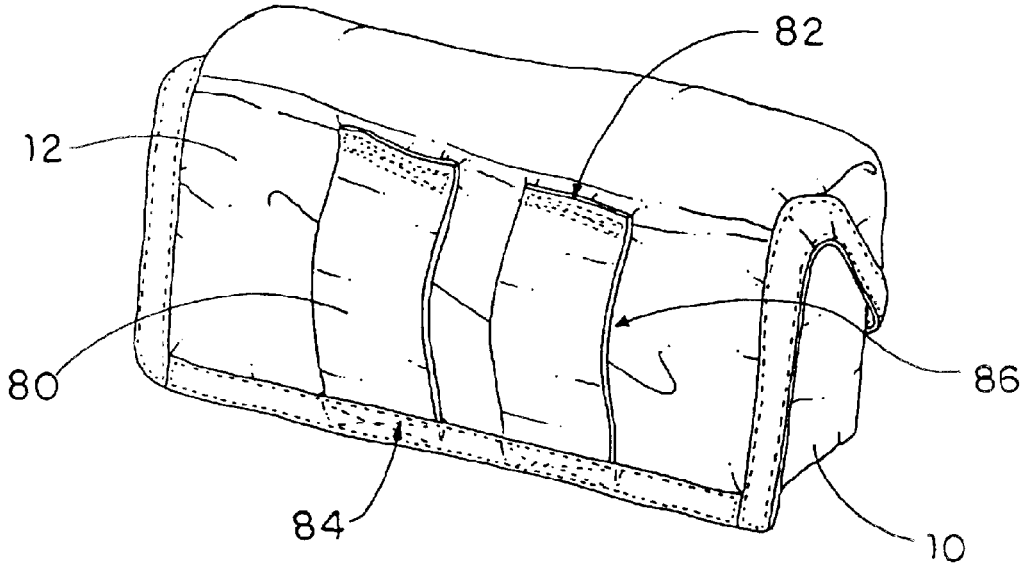
FIG. 6 is a perspective view of the abovementioned ammunition container with attaching means that secures the container to battle load carrying harness according to another preferred embodiment.

Referring to FIG. 6, another alternative of the attaching means is illustrated. The attaching means comprises a pair of webbings 80 with its top and bottom edges 82 and 84 sewn on the back wall 12 of pouch 10 to form a loop between each webbings 80 and the back wall 12. The loop 86 is loose enough to allow a belt or strap passing through, and tight enough to fix the pouch 10 on the belt or strap without substantial unwanted relative movement therebetween. In addition, when the belt or strap is attached to a user's body, the tension between the body and the belt or strap will tighten the attachment between the pouch 10 and the belt or body.

Figure 7:
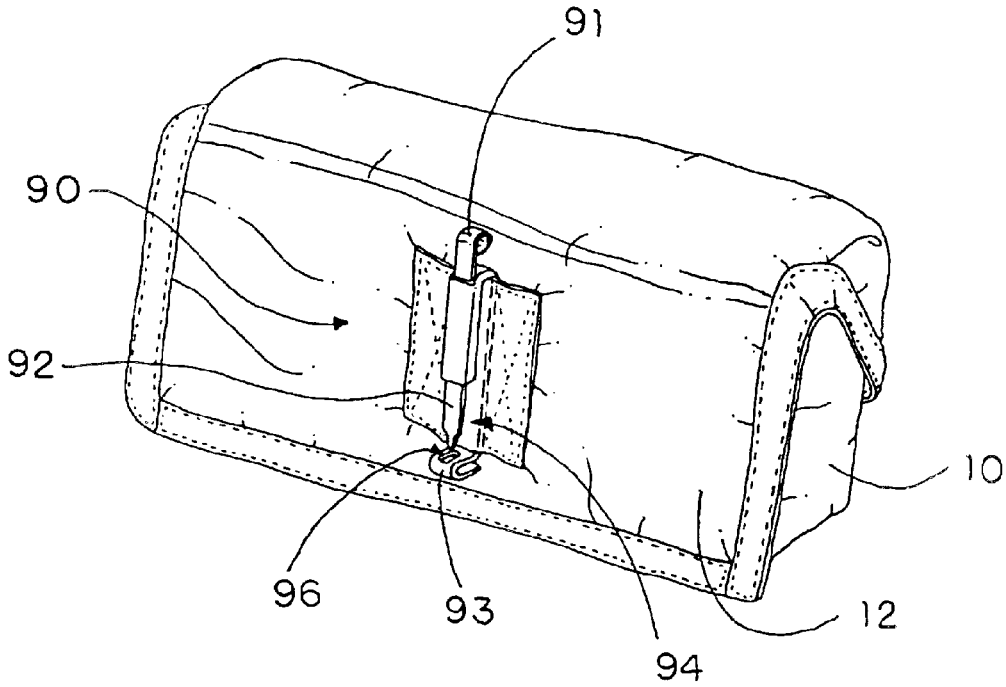
FIG. 7 is a perspective view of the abovementioned ammunition container with attaching means that secures the container to battle load carrying harness according to another preferred embodiment.

Referring to FIG. 7, another alternative of the attaching means is illustrated. The attaching means is an ALICE clip 90, which comprises a frame 91, shown as the broken lines, and gate element 94. The frame 91 has an elongated shape with a bent receiving end 93 with receiving slot 96 formed thereon. The pouch 10 has a patch 98 with its left and right edges sewn on the back wall 12 to from an elongated passage between the patch 98 and the back wall 12 for receiving the ALICE clip 90. The frame 91 is inserted in the elongate passage with its receiving end 93 exposing from the patch 98. The gate door 92 is adapted to slid up to open the gate element 94 for allowing a belt or strap to slid therethrough. Then, the gate door 92 can be pushed down to the receiving slot 96 to close the gate 94 to lock the pouch 10 on the belt or strap.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. An ammunition container for holding at least one magazine having a plurality of receiving slots to respectively receive bullets therein, wherein said ammunition container comprising:

a pouch having a back wall and a front wall overlapped thereon to define a top opening and a storage cavity for receiving the magazine loaded with the bullets therein; and a magazine retaining device, comprising:

an elongated element having an affixing end extended from said storage cavity and a free end extending over said storage cavity toward a front surface of said front wall, wherein said elongated element has a predetermined width adapted for slidably passing through a bullet gap between two bullets held on the magazine, wherein said affixing end of said elongated element is substantially affixed at the mid-portion of an inner side of said back wall so that said elongated element is transversely extended from said storage cavity along a central axis of said top opening for balancing a weight of said pouch when said magazine is stored in said storage cavity; and a fastening unit provided on said front surface of said front wall to detachably fasten with said free end of said elongated element for substantially retaining the magazine within said storage cavity via said elongated element in such a way that each of the bullets is capable of being extracted from the magazine while retaining the magazine in said pouch.

2. An ammunition container for holding at least one magazine having a plurality of receiving slots to respectively receive bullets therein, wherein said ammunition container comprising:

a pouch having a back wall and a front wall overlapped thereon to define a top opening and a storage cavity for receiving the magazine loaded with the bullets therein; and a magazine retaining device, comprising:

an elongated element having an affixing end extended from said storage cavity and a free end extending over said storage cavity toward a front surface of said front wall, wherein said elongated element has a predetermined width adapted for slidably passing through a bullet gap between two bullets held on the magazine, wherein said affixing end of said elongated element is substantially affixed at the mid-portion of an inner side of said back wall so that said elongated element is transversely extended from said storage cavity along a central axis of said top opening for balancing a weight of said pouch when said magazine is stored in said storage cavity; and a fastening unit provided on said front surface of said front wall to detachably fasten with said free end of said elongated element for substantially retaining the magazine within said storage cavity via said elongated element in such a way that each of the bullets is capable of being extracted from the magazine while retaining the magazine in said pouch, wherein said fastening unit comprises a first fastener provided at said free end of said elongated element and a second fastener, having an elongated shaped, transversely provided on said front side of said front wall, wherein said first fastener is detachably and selectively fastened with said first fastener to adjust a width of said top opening of said storage cavity such that said elongated element is adapted for pressing on a top edge of said magazine through said bullet gap to lock up said magazine within said storage cavity.

3. An ammunition container for holding at least one magazine having a plurality of receiving slots to respectively receive bullets therein, wherein said ammunition container comprising:

a pouch having a back wall and a front wall overlapped thereon to define a top opening and a storage cavity for receiving the magazine loaded with the bullets therein; and a magazine retaining device, comprising:

an elongated element having an affixing end extended from said storage cavity and a free end extending over said storage cavity toward a front surface of said front wall, wherein said elongated element has a predetermined width adapted for slidably passing through a bullet gap between two bullets held on the magazine, wherein said affixing end of said elongated element is substantially affixed at the mid-portion of an inner side of said back wall so that said elongated element is transversely extended from said storage cavity along a central axis of said top opening for balancing a weight of said pouch when said magazine is stored in said storage cavity; and a fastening unit provided on said front surface of said front wall to detachably fasten with said free end of said elongated element for substantially retaining the magazine within said storage cavity via said elongated element in such a way that each of the bullets is capable of being extracted from the magazine while retaining the magazine in said pouch, wherein said fastening unit comprises a first fastener provided at said free end of said elongated element and a second fastener, having an elongated shaped, transversely provided on said front side of said front wall, wherein said first fastener is detachably and selectively fastened with said first fastener to adjust a width of said top opening of said storage cavity such that said elongated element is adapted for pressing on a top edge of said magazine through said bullet gap to lock up said magazine within said storage cavity, wherein said first and second fasteners are hook and loop fasteners.

4. The ammunition container, as recited in claim 3, wherein said elongated element comprises an elastic band extended from said storage cavity for providing an elastic retaining force on said magazine to lock up said magazine within said storage cavity.

5. The ammunition container, as recited in claim 3, further comprising a shielding flap extending from said back wall to said front wall so as to enclose said storage cavity of said pouch, thereby preventing the bullets received on the magazine from dropping off from said pouch.

6. The ammunition container, as recited in claim 4, further comprising means for detachably attaching said pouch on a rifle stock.

7. The ammunition container, as recited in claim 4, further comprising means for detachably attaching said pouch on a user's body.

8. An ammunition container for holding at least one magazine having a plurality of receiving slots to respectively receive bullets therein, wherein said ammunition container comprising:

a pouch having a back wall and a front wall overlapped thereon to define a top opening and a storage cavity for receiving said magazine loaded with said bullets therein while said bullets are allowed to be extracted through said top opening; and a magazine retaining device, comprising:

an elongated element having an affixing end extended from said back wall of pouch and a free end extending over said storage cavity toward a front surface of said front wall for riding over said magazine when said magazine is stored in said storage cavity, wherein said elongated element has a predetermined width adapted for slidably passing through a bullet gap between two bullets held on said magazine so as to substantially hold said magazine within said storage cavity in position while said bullets are free to be extracted; and a fastening unit provided on said front surface of said front wall to detachably fasten with said free end of said elongated element for substantially retaining the magazine within said storage cavity via said elongated element in such a manner that each of said bullets is capable of being extracted from said magazine while said magazine is securely retained in said pouch.

9. The ammunition container, as recited in claim 8, wherein said elongated element comprises an elastic band extended from said back wall of said pouch for providing an elastic retaining force on a top edge of said magazine when said elastic band rides on top of said magazine so as to lock up said magazine within said storage cavity.

10. The ammunition container, as recited in claim 8, wherein said fastening unit comprises a first fastener provided at said free end of said elongated element and a second fastener provided on a front side of said front wall, wherein said first fastener is detachably fastened with said first fastener for securing said elongated element on top of said magazine at said bullet gap to lock up said magazine within said storage cavity.

11. The ammunition container, as recited in claim 9, wherein said fastening unit comprises a first fastener provided at said free end of said elongated element and a second fastener provided on a front side of said front wall, wherein said first fastener is detachably fastened with said first fastener for securing said elongated element on top of said magazine at said bullet gap to lock up said magazine within said storage cavity.

12. The ammunition container, as recited in claim 10, wherein said first and second fasteners are hook and loop fasteners.

13. The ammunition container, as recited in claim 11, wherein said first and second fasteners are hook and loop fasteners.

14. The ammunition container, as recited in claim 8, further comprising a shielding flap extending from said back wall towards said front wall to enclose said storage cavity of said pouch for preventing said bullets received on the magazine from dropping off from said pouch.

15. The ammunition container, as recited in claim 9, further comprising a shielding flap extending from said back wall towards said front wall to enclose said storage cavity of said pouch for preventing said bullets received on the magazine from dropping off from said pouch.

16. The ammunition container, as recited in claim 13, further comprising a shielding flap extending from said back wall towards said front wall to enclose said storage cavity of said pouch for preventing said bullets received on the magazine from dropping off from said pouch.

17. The ammunition container, as recited in claim 8, further comprising means for detachably attaching said pouch on a rifle stock.

18. The ammunition container, as recited in claim 16, further comprising means for detachably attaching said pouch on a rifle stock.

19. The ammunition container, as recited in claim 8, further comprising means for detachably attaching said pouch on a user's body.

20. The ammunition container, as recited in claim 16, further comprising means for detachably attaching said pouch on a user's body.

* * * * *